US005100358A

United States Patent [19]

Volgger

[11] Patent Number: 5,100,358

[45] Date of Patent: Mar. 31, 1992

[54] COUPLING DEVICE FOR POLYGONAL ELEMENTS DESIGNED TO FORM SPATIAL STRUCTURES AND IN PARTICULAR POLYHEDRAL TOYS

[76] Inventor: Josef Volgger, Racines di Fuori, b/b 1-39040 Racines, Italy

[21] Appl. No.: 544,193

[22] Filed: Jun. 26, 1990

[51] Int. Cl.[5] ..... A63H 33/08

[52] U.S. Cl. ..... 446/104; 446/116; 446/120

[58] Field of Search ..... 446/112, 113, 114, 115, 446/116, 119, 120, 122; 24/324, 297, 453

[56] References Cited

U.S. PATENT DOCUMENTS

| | | | |
|---|---|---|---|
| 3,238,586 | 3/1966 | Stoffel | 24/453 |
| 4,055,019 | 10/1977 | Harvey | 446/116 |
| 4,253,268 | 3/1981 | Mayr | 446/116 |

*Primary Examiner*—Robert A. Hafer
*Assistant Examiner*—David J. Kenealy
*Attorney, Agent, or Firm*—Shlesinger, Fitzsimmons & Shlesinger

[57] ABSTRACT

A polygonal element has at each of its sides a coupling device designed to connect said element with an identical or different polygonal element equipped with a complementary coupling device in such a manner as to form a polyhedral spatial structure with a plurality of polygonal elements of this type. In accordance with the invention the coupling device comprises along each side of a polygonal element at least one female recess and at least one male projection complementary to at least one coupling device of other polygonal elements. Each recess has on at least one side parallel to the direction of penetration of the projection of a complementary coupling device an elastically yielding undercut and the projection has an undercut complementary to the recess. The undercuts are aligned together on a common axis so as to permit reciprocal rotation of the two coupled polygonal elements together. Preferably at least one projection has near a recess a discharge notch so as to increase the elastic yielding of the undercut in relief or in depression provided there.

2 Claims, 2 Drawing Sheets

COUPLING DEVICE FOR POLYGONAL ELEMENTS DESIGNED TO FORM SPATIAL STRUCTURES AND IN PARTICULAR POLYHEDRAL TOYS

The present invention relates to a coupling device for polygonal elements designed to form spatial structures and in particular polyhedral toys.

It is known how to connect together elements of various geometrical forms, e.g. by engagement, to secure spatial structures representing desired figures.

It is also known how to couple together elements by means of pins so as to achieve reciprocal rotation of said elements.

Whereas in the former case the operation in the majority of cases is repetitive with a plurality of modes, in the latter case only two elements are ordinarily combinable to keep them rotating together.

The object of the present invention is to propose a coupling devide for polygonal elements in such a manner as to be able to rotate each element in relation to the other in a position wherein other elements can be connected in such a manner as to from specified open or closed spatial structures.

This object is achieved in accordance with the invention by the embodiment of a coupling device for polygonal elements designed to form spatial structures and in particular polyhedral toys wherein a polygonal element has at each side a coupling device designed to connect said element with an indentical or different polygonal element having a complementary coupling device so as to form a polyhedral spatial structure with a plurality of polygonal elements of this tyupe and characterized by the characterizing part of claim 1.

Figure 1:
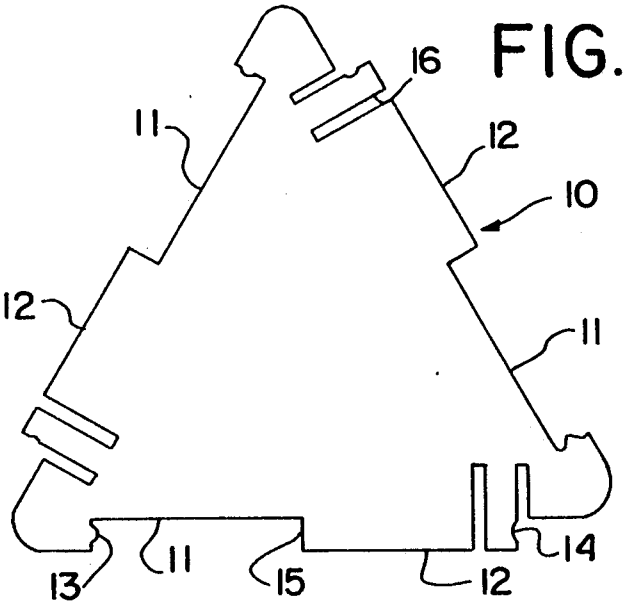
Figure 2:
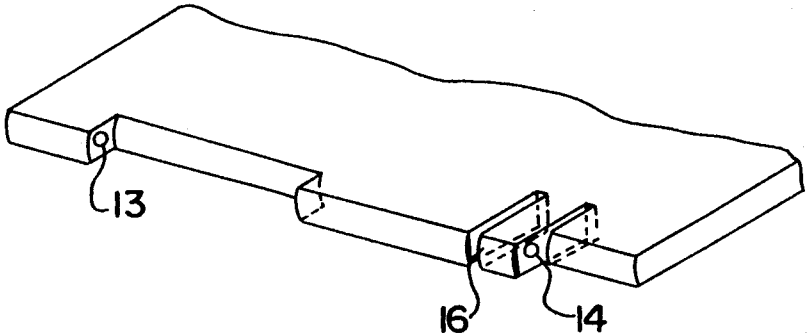
Figure 3:
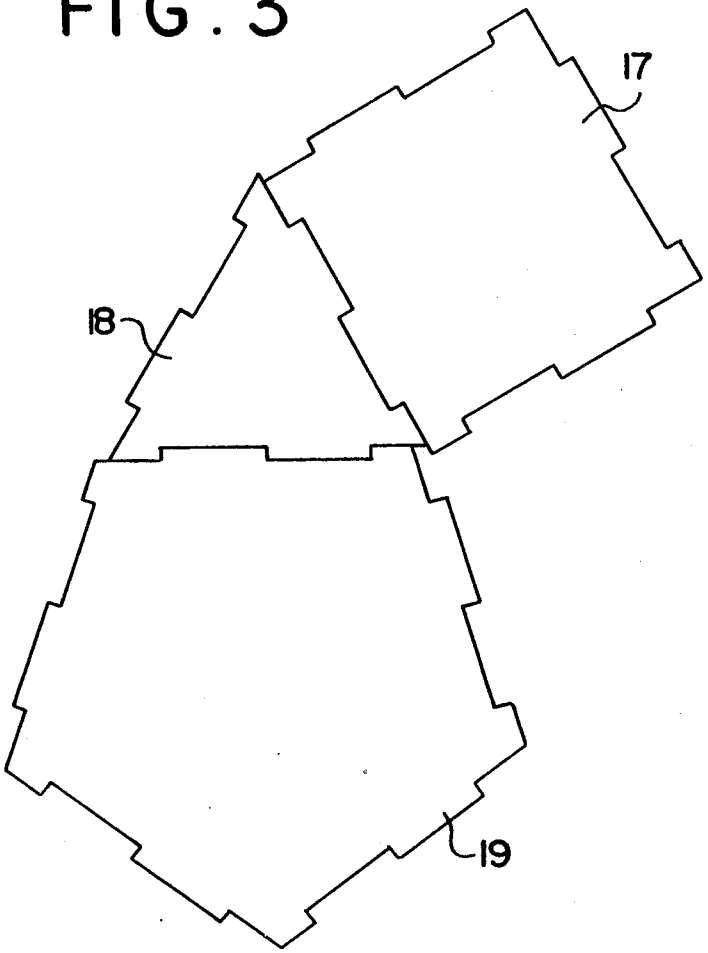
Figure 4:
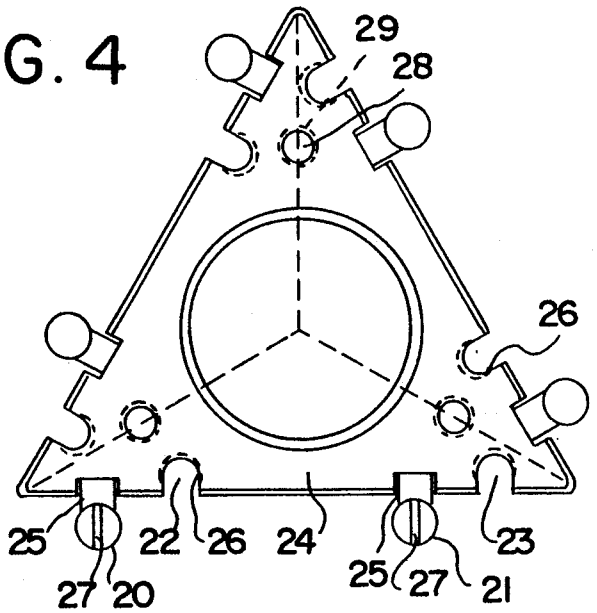
Figure 5:
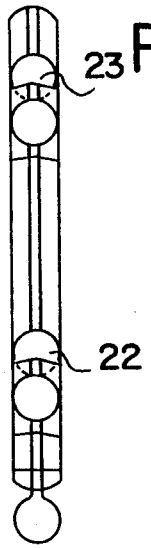
Figure 7:
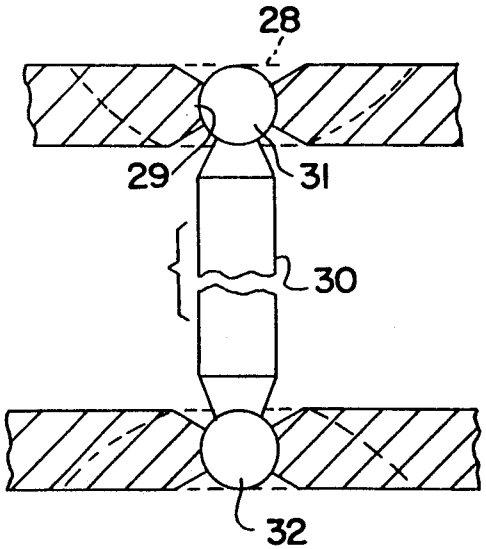
Figure 6:
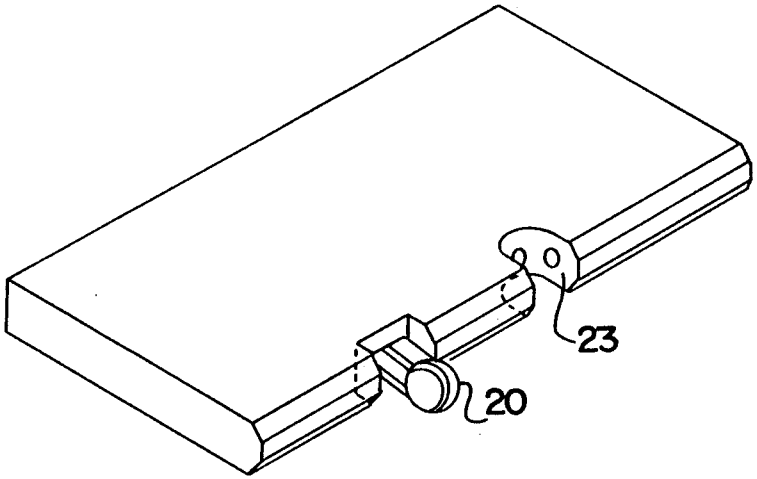

Other details and the advantages of the device in accordance with the invention will be clarified by the following description of two forms of embodiment represented in the figures of the annexed drawings wherein FIG. 1 shows a plan view of a basically triangular element with two coupling devices in accordance with the invention, FIG. 2 shows a perspective view of the coupling device in accordance with the invention along one side of a polygonal element, FIG. 3 shows an example of three polygonal elements, FIG. 4 shows a triangular element with a coupling device in a second form of embodiment, FIG. 5 shows a view of the element of FIG. 4 in the direction of the arrow V, FIG. 6 shows a perspective view of the coupling device in accordance with FIG. 4 and 5, and FIG. 7 shows a cross section of a variant for connection of two polygonal elements at a distance.

As shown in FIG. 1 *a* triangular element, indicated generally by reference number 10,has on each side a coupling device.

In accordance with the invention the coupling device has a cavity 11 and a projection 12. The cavity 11 is female in form to complement the projection 12 which is male in form. Perpendicular to the direction of penetration of the projection 12 there protrudes at the side of the cavity 11 and elastically yielding boss 13. The boss 13 is on the side opposite the edge 15 of the cavity in common with the projection 12. On the edge of the projection 12 opposite the edge 15 there is a depression 14 which complements the boss 13. Near the depression 14 in the projection 12 there is made a notch 16 designed to discharge the material so as to make the depression 14 elastically yielding toward the boss 13. The cavity 11 and the projection 12 on each side of each polygonal element are arranged in the same sequence in such a manner that it is possible to couple polygonal elements called for by said coupling devices and that they can be coupled by snapping together if they are turned 180° from each other in the plane. FIG. 3 shows an example of three polygonal elements of which one is square 17, one is triangular 18 and one is pentagonal.

Each element can be advantageously coupled with the other in any position rotated in relation to the axis formed by the boss 13 and the depression 14. It is thus possible to form a spatial structure having a plurality of possible combinations.

FIGS. 4 and 5 show a coupling device in accordance with the invention in another form of embodiment. In this case there are provided two projections 20 and 21 and two recesses or seats 22 and 23. The distance between the projections 20 and 21 is equal to the distance between the recesses 22 and 23. The pair of projections 20 and 21 is also moved a certain distance in relation to the pair of recesses 22 and 23.

Each projection 20, 21 is formed of a basically spherical head connected to the polygonal element 24 by means of an elastic tongue 25 designed to rotate around the side of the polygonal element 24. Each spherical head 20, 21 is also completely insertable by snapping into the seats 22 and 23 of another element provided in said coupling device. This is indicated in the figures in broken lines with a spherical undercut 26.

Each head peferably has a notch 27 in the direction of penetration of said spherical head 20, 21 in the recess 22, 23. The elasticity of the material for reciprocal assembly of various polygonal elements is thus further endured. As may be seen in this case, also, as described above with reference to the first form of embodiment, it is possible to form a plurality of polyhedral spatial structures even by using different polygonal elements.

The individual polygonal elements can also be provided with circular seats 28 and undercut seats 29 designed to receive connecting elements 30. Each connecting element 30 is in this case provided at each of its end with a sperical head 31 and 32 which are complementary to the seats 28. In this case, also, the spherical heads 31 and 32 can be provided with notches, which are not further drawn and are designed to make said heads elastically yielding.

Even though in the figures flat polygonal elements are showhn they could be three-dimensional in form, i.e. it is only important that the individual coupling elements be located on the sides lying in the same plane.

The material of each individual polygonal element can be of any type. It is only important that the individual devices have sufficient elasticity to be coupled together by snapping.

With the coupling devices for polygonal elements described the latter are suited mainly for educational spatial toys.

I claim:

1. Coupling device for polygonal elements designed to form spatial structures and in particular polyhedral toys wherein a polygonal element has at each of its sides a coupling device designed to connect said element with an identical or different polygonal element equipped with a complementary coupling device in such a manner as to form a polyhedral spatial structure with a plurality of polygonal elements of this type and characerized in that the coupling device along each side of a polygonal element comprises at least one female recess and at least one male projection comlementary to and engageable with at least one like coupling device formed along each of the sides of other polygonal elements, each said recess having an elastically yielding head portion projecting thereinto from at least one of the sides thereof, and the other side thereof extending parallel to the direction of penetration of the projection of one element into the recess of another element, and each projection having in one end thereof a depression complementary to the head portion of the associated recess, the depressions and head portions of two coupled elements being aligned together on a common axis so as to permit reciprocal rotation of the two polygonal elements coupled together, and each of the projections on one side of an element having therein a discharge notch adjacent said one end of the projection containing said depression.

2. Device in accordance with claim 1 characterized in that said recess has a basically rectangular form and said head portion is complementary to said depression on said one end of the projection, and said projection is complementary in cnfiguration to the recess.

* * * * *